US011459225B2

(12) United States Patent
Birdsall et al.

(10) Patent No.: US 11,459,225 B2
(45) Date of Patent: Oct. 4, 2022

(54) SYSTEMS AND METHODS FOR MANAGING REFUELING INTERACTIONS

(71) Applicant: Toyota Motor Engineering & Manufacturing North America, Inc., Plano, TX (US)

(72) Inventors: Jacquelyn Birdsall, Pasadena, CA (US); Takehito Yokoo, Aliso Viejo, CA (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 188 days.

(21) Appl. No.: 16/706,168

(22) Filed: Dec. 6, 2019

(65) Prior Publication Data

US 2021/0171334 A1 Jun. 10, 2021

(51) Int. Cl.

| | |
|---|---|
| ***B67D 7/34*** | (2010.01) |
| ***B67D 7/32*** | (2010.01) |
| ***G07C 5/00*** | (2006.01) |

(52) U.S. Cl.

CPC ..... *B67D 7/3218* (2013.01); *B67D 7/3281* (2013.01); *B67D 7/348* (2013.01); *G07C 5/008* (2013.01); *B67D 2007/329* (2013.01)

(58) Field of Classification Search

CPC .... B67D 7/347; B67D 7/3281; B67D 7/3218; B67D 7/065; B67D 2007/329; G07C 5/008

See application file for complete search history.

(56) References Cited

U.S. PATENT DOCUMENTS

| | | | | |
|---|---|---|---|---|
| 8,738,277 | B1 | 5/2014 | Kurosawa et al. | |
| 9,227,519 | B2 | 1/2016 | Heuer et al. | |
| 10,329,137 | B1 * | 6/2019 | Prasad | G06Q 20/16 |
| 2009/0187416 | A1 | 7/2009 | Baer et al. | |
| 2010/0241542 | A1 | 9/2010 | Pinkusevich et al. | |
| 2012/0095920 | A1 * | 4/2012 | McQuade | H04L 9/3226 713/168 |
| 2014/0305545 | A1 * | 10/2014 | Butler, Jr. | B67D 7/0401 141/94 |
| 2015/0306967 | A1 | 10/2015 | Cohen | |
| 2016/0035001 | A1 | 2/2016 | Driscoll et al. | |
| 2017/0233243 | A1 * | 8/2017 | McNicholas | B64G 5/00 141/94 |
| 2018/0072175 | A1 | 3/2018 | Sarkar et al. | |
| 2019/0156328 | A1 | 5/2019 | Nelson et al. | |
| 2020/0062579 | A1 * | 2/2020 | Fehr | B60S 5/02 |

* cited by examiner

*Primary Examiner* — Jason K Niesz

(74) *Attorney, Agent, or Firm* — Christopher G. Darrow; Darrow Mustafa PC

(57) ABSTRACT

System, methods, and other embodiments described herein relate to controlling a fuel dispenser. In one embodiment, a method of controlling a fuel dispenser includes broadcasting a pairing signal to a vehicle, receiving, from the vehicle, a confirmation signal confirming completion of a pairing process between the fuel dispenser and the vehicle, transmitting, subsequent to the confirmation signal, a disable signal to the vehicle in response to data from one or more proximity sensors indicating that the vehicle is within a threshold range and a determination that the vehicle is refueling, and transmitting an enable signal to the vehicle in response to a determination that the vehicle is no longer refueling. The disable signal disables a moving capability of the vehicle, and the enable signal restores the moving capability of the vehicle.

20 Claims, 5 Drawing Sheets

SYSTEMS AND METHODS FOR MANAGING REFUELING INTERACTIONS

TECHNICAL FIELD

The subject matter described herein relates to systems and methods for managing interactions between a vehicle and a fuel dispenser, and, more particularly, to preventing damage to fuel dispensers due to premature vehicle departure.

BACKGROUND

While refueling a vehicle, a driver may temporarily depart to buy snacks, use the restroom, etc., or otherwise become distracted from the refueling process. Consequently, in some situations a driver may forget to remove the fuel nozzle (or power plug in the case of hybrid/electric vehicles) from the vehicle before driving away from the fuel station. Such premature drive-offs can cause significant damage to fuel dispensers and vehicles and can produce dangerous situations for incident bystanders.

SUMMARY

In one embodiment, example systems and methods are disclosed for managing interactions between a vehicle and a fuel dispenser.

Therefore, a fuel dispenser control system is disclosed. In one approach, the disclosed system includes a wireless communication device, one or more proximity sensors, one or more processors and a memory communicably connected to the one or more processors, storing a communication module including one or more instructions that, when executed by the one or more processors, cause the one or more processors to broadcast a pairing signal to a vehicle and receive a confirmation signal from the vehicle confirming completion of a pairing process between the fuel dispenser and the vehicle, and a control module including one or more instructions that, when executed by the one or more processors, cause the one or more processors to transmit, subsequent to the confirmation signal, a disable signal to the vehicle in response to data from the one or more proximity sensors indicating that the vehicle is within a threshold range and a determination that the vehicle is refueling, and to transmit an enable signal to the vehicle in response to a determination that the vehicle is no longer refueling. The disable signal disables a moving capability of the vehicle, and the enable signal restores the moving capability of the vehicle.

In one embodiment a method of controlling a fuel dispenser is disclosed. The method includes broadcasting a pairing signal to a vehicle, receiving, from the vehicle, a confirmation signal confirming completion of a pairing process between the fuel dispenser and the vehicle, transmitting, subsequent to the confirmation signal, a disable signal to the vehicle in response to data from one or more proximity sensors indicating that the vehicle is within a threshold range and a determination that the vehicle is refueling, and transmitting an enable signal to the vehicle in response to a determination that the vehicle is no longer refueling. The disable signal disables a moving capability of the vehicle, and the enable signal restores the moving capability of the vehicle.

In one embodiment, a non-transitory computer-readable medium is disclosed. The computer-readable medium stores instructions that when executed by one or more processors cause the one or more processors to perform the disclosed functions. The instructions include instructions to broadcast a pairing signal to a vehicle, receive, from the vehicle, a confirmation signal confirming completion of a pairing process between the fuel dispenser and the vehicle, transmit, subsequent to the confirmation signal, a disable signal to the vehicle in response to data from one or more proximity sensors indicating that the vehicle is within a threshold range and a determination that the vehicle is refueling, transmit an enable signal to the vehicle in response to a determination that the vehicle is no longer refueling. The disable signal disables a moving capability of the vehicle, and the enable signal restores the moving capability of the vehicle.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one embodiment of the boundaries. In some embodiments, one element may be designed as multiple elements or multiple elements may be designed as one element. In some embodiments, an element shown as an internal component of another element may be implemented as an external component and vice versa. Furthermore, elements may not be drawn to scale.

DETAILED DESCRIPTION

Systems, methods and embodiments associated with controlling interactions between a vehicle and a fuel dispenser (e.g., at a refueling station or a gas station) are disclosed. The disclosed systems provide multiple improvements that enhance safety for vehicles, drivers, bystanders and dispensers at a fuel station.

In one embodiment, a fuel dispenser control system can periodically broadcast a short-range scanning signal to search for vehicles in the proximity to pair with. The pairing process may be executed using available techniques. The scanning signal can include encoded information that identifies, for example, the particular fuel dispenser, the fueling station, time information, pairing authentication requirements, etc. When a vehicle comes within range and detects the scanning signal, in response the vehicle can transmit a pairing signal including identification information for the vehicle, an authentication key, etc. In one or more embodiments the vehicle or a driver of the vehicle may transmit a PIN to complete the pairing process.

When the driver opens the fuel door of the vehicle, the vehicle can transmit a refueling signal indicating that the vehicle is initiating a refueling session at the fuel dispenser. In one or more embodiments, the refueling signal can alternatively be triggered, for example, from a fuel cap being removed from a fuel inlet port of the vehicle, or another indication that a refueling process is being initiated, such as the fuel nozzle being removed from the fuel dispenser. In response to the refueling signal, the fuel dispenser can transmit a disabling signal to the vehicle that prevents the vehicle from moving, for example, by preventing the vehicle engine from starting and/or shifting into gear. Thus, the vehicle is prevented from driving away from the fuel dispenser while in the middle of refueling.

When the driver stops refueling the vehicle (i.e., removes the fuel nozzle from the vehicle and closes the refueling port), the vehicle can transmit a completion signal to the fuel dispenser, for example, triggered by the closing of the fuel port. In response to the completion signal the fuel dispenser transmits an enabling signal to the vehicle to enable the vehicle to move, for example, by enabling the engine to start and/or shift into gear. Accordingly, the vehicle can safely depart without damaging the fuel dispenser. Additional details and various embodiments will be discussed below.

Figure 1:
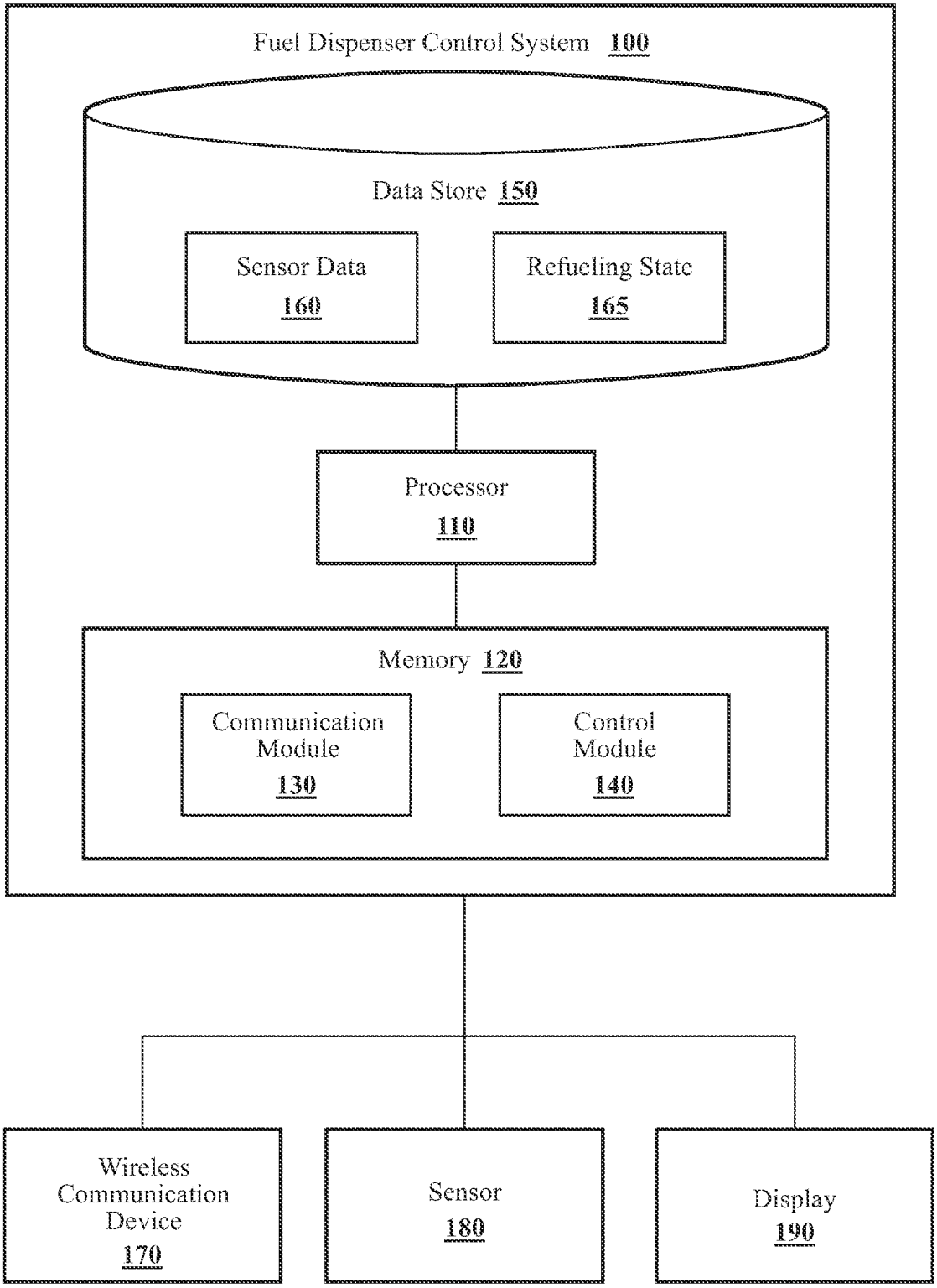
FIG. 1 illustrates an embodiment of a fuel dispenser control system according to the disclosed subject matter.

Referring to FIG. 1, one embodiment of a fuel dispenser control system 100 is illustrated. While arrangements will be described herein with respect to the fuel dispenser control system 100, it should be understood that the disclosed embodiments are not limited to a unitary system as illustrated. In some implementations, the fuel dispenser control system 100 may be embodied as a cloud-computing system, a cluster-computing system, a distributed computing system (e.g., across multiple facilities), a software-as-a-service (SaaS) system, and so on. Accordingly, the fuel dispenser control system 100 is illustrated and discussed as a single computing system which may be disposed in an associated fuel dispenser for purposes of discussion, but should not be interpreted to limit the overall possible configurations in which the disclosed components may be configured. For example, the separate modules, memories, databases, and so on may be distributed among various computing systems in varying combinations.

The fuel dispenser control system 100 also includes various elements. It should be understood that in various embodiments and configurations, depending on the actual layout and implementation, it may not be necessary for the fuel dispenser control system 100 to include all of the elements shown in FIG. 1. The fuel dispenser control system 100 can have any combination of the various elements shown in FIG. 1. Further, the fuel dispenser control system 100 can have additional elements to those shown in FIG. 1. In some arrangements, the fuel dispenser control system 100 may be implemented without one or more of the elements shown in FIG. 1. Further, while the various elements are shown as being located within the fuel dispenser control system 100 in FIG. 1, it will be understood that one or more of these elements can be located external to the fuel dispenser control system 100. Further, the elements shown may be physically separated by large distances.

Additionally, it will be appreciated that for simplicity and clarity of illustration, where appropriate, reference numerals have been repeated among the different figures to indicate corresponding or analogous elements. In addition, the discussion outlines numerous specific details to provide a thorough understanding of the embodiments described herein. Those of skill in the art, however, will understand that the embodiments described herein may be practiced using various combinations of these elements.

The fuel dispenser control system 100 is associated with a fuel dispenser and is implemented to perform methods and other functions as disclosed herein relating to transmitting, for example, pairing and control signals to a vehicle, and preventing the vehicle from damaging the fuel dispenser, component parts such as a fuel nozzle or a hose of the fuel dispenser, or the vehicle itself. The noted functions and methods will become more apparent with a further discussion of the figures.

The fuel dispenser control system 100 is shown as including a processor 110. In various implementations the processor 110 may be a part of the fuel dispenser control system 100, the fuel dispenser control system 100 may access the processor 110 through a data bus or another communication pathway, the processor 110 may be a remote computing resource accessible by the fuel dispenser control system 100, and so on. In any case, the processor 110 is an electronic device such as a microprocessor, an ASIC, or another computing component that is capable of executing machine-readable instructions to produce various electronic outputs therefrom that may be used to control or cause the control of other electronic devices.

In one embodiment, the fuel dispenser control system 100 includes a memory 120 that stores a communications module 130 and a control module 140. The memory 120 is a random-access memory (RAM), read-only memory (ROM), a hard-disk drive, a flash memory, or other suitable memory for storing the modules 130 and 140. The modules 130 and 140 are, for example, computer-readable instructions that when executed by the processor 110 cause the processor 110 to perform the various functions disclosed herein. In various embodiments, the modules 130 and 140 can be implemented in different forms that can include but are not limited to hardware logic, an ASIC, components of the processor 110, instructions embedded within an electronic memory, and so on.

The communications module 130 is generally constructed including instructions that function to control the processor 110 to execute a pairing process, for example, to broadcast a scanning or pairing signal to a vehicle and receive a confirmation signal from the vehicle confirming completion of a pairing process between the fuel dispenser and the vehicle.

The control module 140 is generally constructed including instructions that function to control the processor 110 to transmit, subsequent to receiving the confirmation signal, a disable signal to the vehicle in response to data from the one or more proximity sensors indicating that the vehicle is within a threshold range and a determination that the vehicle is refueling, and to transmit an enable signal to the vehicle in response to a determination that the vehicle is no longer refueling. In one or more embodiments, the disable signal disables a starting capability of the vehicle and the enable signal restores the starting capability of the vehicle.

With continued reference to the fuel dispenser control system 100, in one embodiment, the system 100 includes a data store 150, which may be implemented as a database 150. The database 150 is, in one embodiment, an electronic data structure that may be stored in the memory 120 or elsewhere, a distributed memory, a cloud-based memory, or another data store and that is configured with routines that can be executed by the processor 110 for analyzing stored data, providing stored data, organizing stored data, and so on. Thus, in one embodiment, the database 150 stores data used by the modules 130 and 140 in executing various determinations. In one embodiment, the database 150 stores data including sensor data 160 and a refueling state 165 of a paired vehicle.

The fuel dispenser control system 100 can also include or be operably connected to a wireless communication device 170 that allows the communication module 130 to communicate, for example, with vehicle systems, fuel station computing devices, communication networks, and other systems. The communication device 170 can be configured to communicate, for example, over a local area network, a wide area network, directly with a target system via an established protocol such as Bluetooth®, WiFi™, infrared (IR), vehicle-to-everything (V2X), or through other communications methods.

The fuel dispenser control system 100 can further include or be operably connected to a sensor 180. In one or more embodiments the sensor 180 can include one or more proximity sensors, such as laser, lidar, radar, sonar, ultrasonic, IR, etc., that can detect the presence of a vehicle approaching the fuel dispenser and output sensor data 160 indicating a range or distance between the fuel dispenser and the approaching vehicle. The fuel dispenser control system 100 can also include or be operably connected to a display 190, as will be discussed further below.

Figure 2:
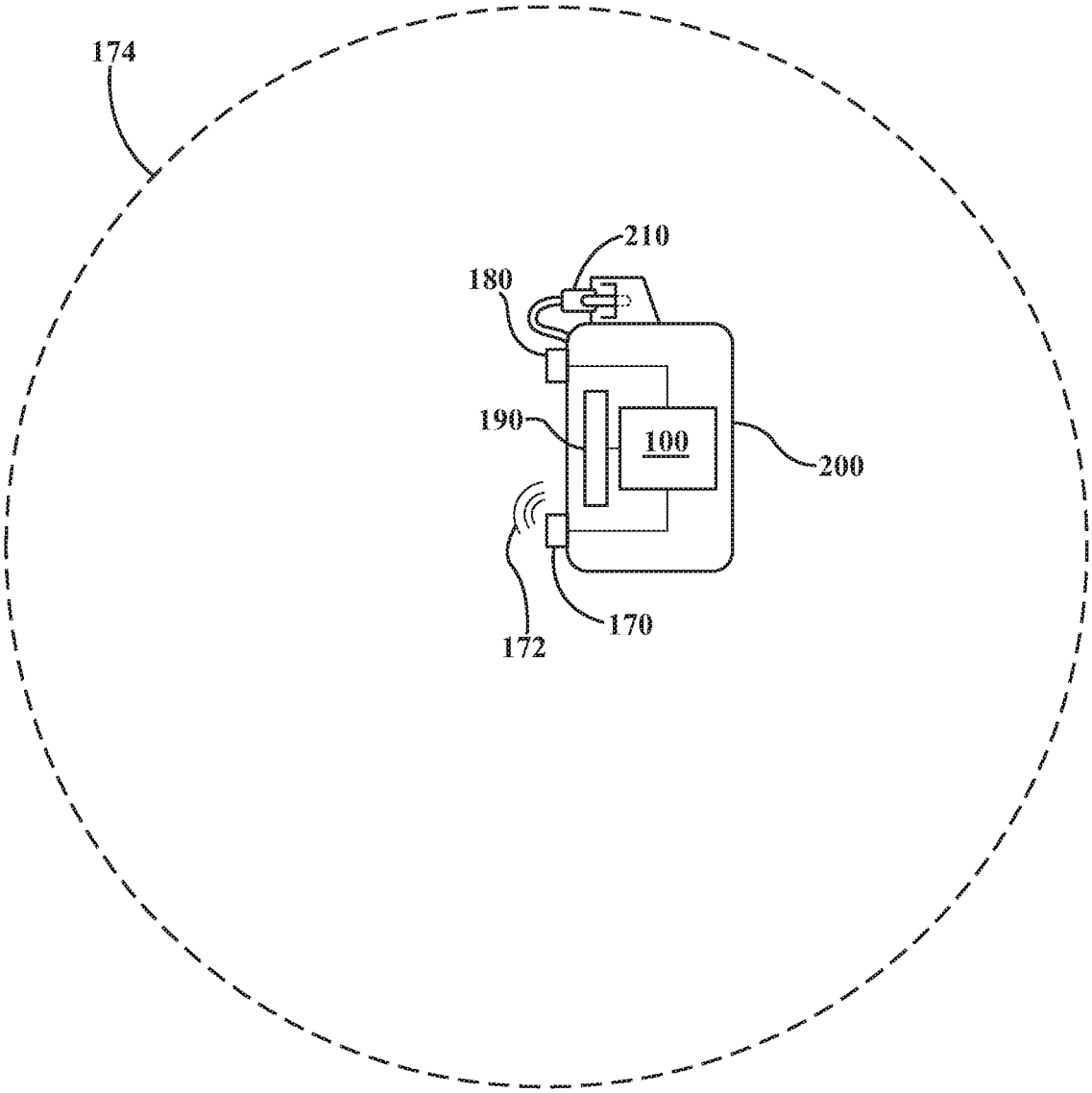
FIG. 2 illustrates an example fuel dispenser system according to the disclosed subject matter.

FIG. 2 illustrates an example fuel dispenser 200 that can implement or be controlled by the disclosed fuel dispenser control system 100. In one or more embodiments the fuel dispenser control system 100 is housed within the associated fuel dispenser 200, as shown. In one or more other embodiments, the fuel dispenser control system 100 can be implemented on a system external to the fuel dispenser 200 and in electronic communication with the fuel dispenser 200.

Although the fuel dispenser 200 is depicted as gas fuel dispenser 200, the disclosed subject matter is not limited to this particular implementation and can be applied to other types of dispensers, such as an electric fuel dispenser or a hydrogen fuel dispenser. The fuel dispenser 200 can be located, for example, at a fueling station, and can be one of multiple fuel dispensers.

The fuel dispenser 200 can include the display 190, which can show information including notifications, sales, advertisements, etc., and a fuel nozzle 210, which may be used to distribute fuel to a vehicle. In one or more implementations the fuel nozzle 210 can include, for example, a flexible hose (not shown) and a pumping mechanism (not show). The fuel dispenser 200 can include a sensor (not shown) to detect removal of the fuel nozzle 210 from the fuel dispenser 200.

In one or more embodiments the fuel dispenser control system 100 can control the communication device 170 that is operably connected with the fuel dispenser control system 100 to broadcast a scanning or pairing signal 172. The information carried in the pairing signal 172 can be determined using known pairing protocols that can achieve secure two-way communication between the fuel dispenser control system 100 and a target vehicle. Since the fuel dispenser 200 may be located at a station with multiple dispensers, in one or more embodiments the pairing signal 172 can implemented to have limited range 174 that extends to the immediate vicinity of the fuel dispenser 200. In one or more embodiments, the fuel dispenser 200 can be positioned such that the range 174 does not overlap with a range of a neighboring fuel dispenser.

Figure 3:
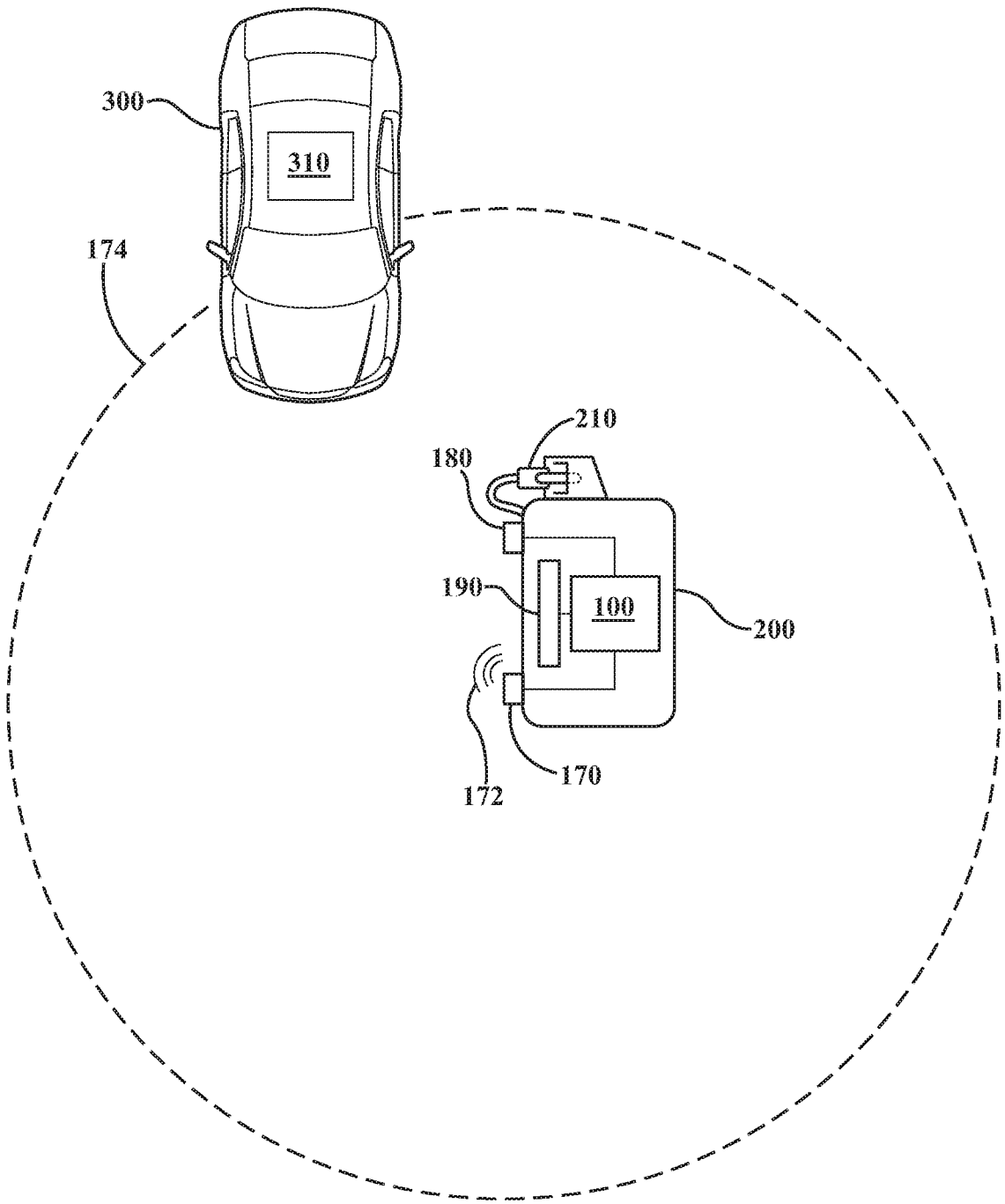
FIG. 3 illustrates a vehicle approaching a fuel dispenser system according to the disclosed subject matter.

FIG. 3 illustrates a vehicle 300 approaching the fuel dispenser 200. The vehicle can include a vehicle control system 310, e.g., one or more electronic control units (ECUs) that control various systems of the vehicle 300. When the vehicle 300 enters the range 174 of the pairing signal 172, the vehicle 300 (via the vehicle control system 310) receives the signal and transmits a responsive signal, e.g., a confirmation signal, to complete the pairing process and establish a secure communication channel with the fuel dispenser 200. After the pairing process is complete the communication module 130 can periodically ping the vehicle 300 to confirm that the established pairing is maintained. When the vehicle leaves the range 174 and no longer responds to the pings from the communication module 130, the pairing is nullified.

Figure 4:
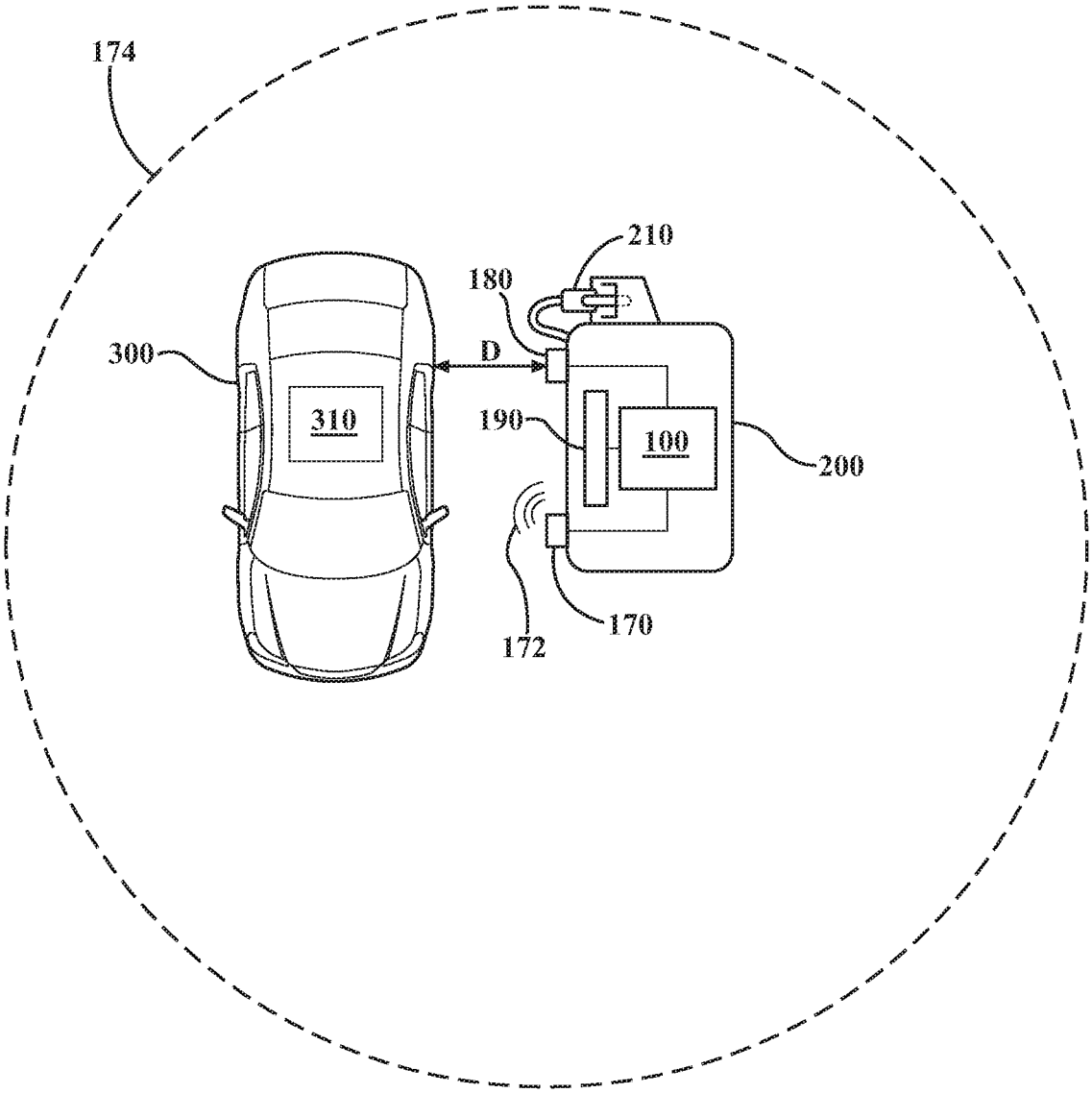
FIG. 4 illustrates a vehicle stopping at a position near a fuel dispenser according to the disclosed subject matter.

FIG. 4 illustrates the vehicle 300 stopping in a position near the fuel dispenser 200 in preparation of a refueling session. The sensor 180 outputs sensor data 160 indicating a distance D between the vehicle 300 and the fuel dispenser 200. When the distance D is below a threshold amount, the control module 140 determines a state of the refueling session. More particularly, in one or more embodiments the possible states can include at least: 1) awaiting a refueling session, 2) initiation of the refueling session, 3) refueling session in progress, and 4) conclusion of the refueling session.

In one or more embodiments, the control module 140 determines the state of the refueling session based at least in part on an algorithm that determines the state based on detecting the fuel nozzle 210. For example, detecting the vehicle within the threshold distance D while the fuel nozzle 210 has not been detected to be removed from the fuel dispenser 200 can indicate a state of awaiting a refueling session. Detecting removal of the fuel nozzle 210 from the fuel dispenser 200 can indicate initiation of the refueling session. After initiation, while the fuel nozzle 210 is not detected to have been replaced, the refueling session state can be considered to be in progress. Detecting the replacement of the fuel nozzle 210 back at the fuel dispenser 200 can indicate the conclusion of the refueling session.

In one or more other embodiments, the control module 140 can determine the state of the refueling station based at least in part on signals received from the vehicle 300. For example, the vehicle 300 can transmit a signal, e.g., a refueling signal, when a fuel port door (not shown) of the vehicle 300 is opened or when the vehicle control system 310 detects insertion of the fuel nozzle 210 into a fuel inlet (not shown) of the vehicle 300. Conversely, the vehicle 300 can transmit a second signal, e.g., a completion signal, when the fuel port door (not shown) of the vehicle 300 is closed or when the vehicle control system 310 detects removal of the fuel nozzle 210 from the fuel inlet (not shown) of the vehicle 300. Thus, the control module 140 detecting the vehicle 300 within the threshold distance D while no refueling signal has been received from the vehicle 300 indicates a state of awaiting a refueling session. The control module 140 receiving the refueling signal from the vehicle 300 indicates initiation of the refueling session. After initiation, while the completion signal is not received from the vehicle 300, the refueling session can be considered to be in progress. The control module 140 receiving the completion signal from the vehicle 300 can indicate the conclusion of the refueling session.

In one or more embodiments, the control module 140 can determine the state of the refueling session based on a combination of one or more of the above described techniques. For example, the control module 140 can determine initiation of a refueling session based on detecting that the fuel nozzle 210 has been removed from the fuel dispenser 200 and receiving a refueling signal from the vehicle 300. Similarly, the control module 140 can determine completion of the refueling session based on detecting that the fuel nozzle 210 has been replaced at the fuel dispenser 200 and receiving a completion signal from the vehicle 300.

In any case, when the control module 140 determines that a refueling session has been initiated, the control module 140 transmits a disabling signal to the vehicle 300. The disabling signal disables the vehicle 300 from moving, for example, by disabling the engine of the vehicle 300 from starting while the refueling session is in progress, and thus prevents an accidental drive-off from occurring during the refueling session. The disabling signal can be implemented using a pre-determined protocol based on the vehicle 300. For example, during the pairing process the vehicle 300 can provide identification information that includes information that the control module 140 can use to determine or look-up a code to transmit within the disabling signal that will disable an engine starting capability or gear-shifting capability of the vehicle 300. In one or more embodiments, the disable signal disables only the engine from starting and/or shifting into gear while other systems of the vehicle 300 remain unaffected.

When the control module 140 determines that the refueling session is complete, the control module 140 transmits an enabling signal that enables the vehicle 300 to move, for example, by enabling the starting capability and/or gear-shifting capability of the engine of the vehicle 300.

In one or more embodiment, when the control module 140 transmits the disabling signal, the control module 140 can also transmit a notification to notify the driver that the vehicle 300 is disabled from moving. The notification can be transmitted, for example, to the display 190 of the fuel dispenser 200, to a display (not shown) of the vehicle 300, or to another computing device such as a cell phone or smart watch. Conversely, when the control module 140 transmits the enabling signal, the control module 140 can correspondingly transmit a notification to notify the driver that moving capability of the vehicle 300 has been enabled.

In one or more embodiments, the control module 140 can transmit the enable signal at any point in time based on a manual override. The notification can include instructions for carrying out the manual override procedure to manually cause the control module 140 to transmit an enable signal. For example, the manual override procedure can be implemented in a code to be entered in a panel on the fuel dispenser 200, or a procedure carried out within the vehicle 300, such as transmitting a pre-determined override code conveyed during the pairing process or forcing an unpairing of the vehicle 300 and the fuel dispenser control system 100.

Figure 5:
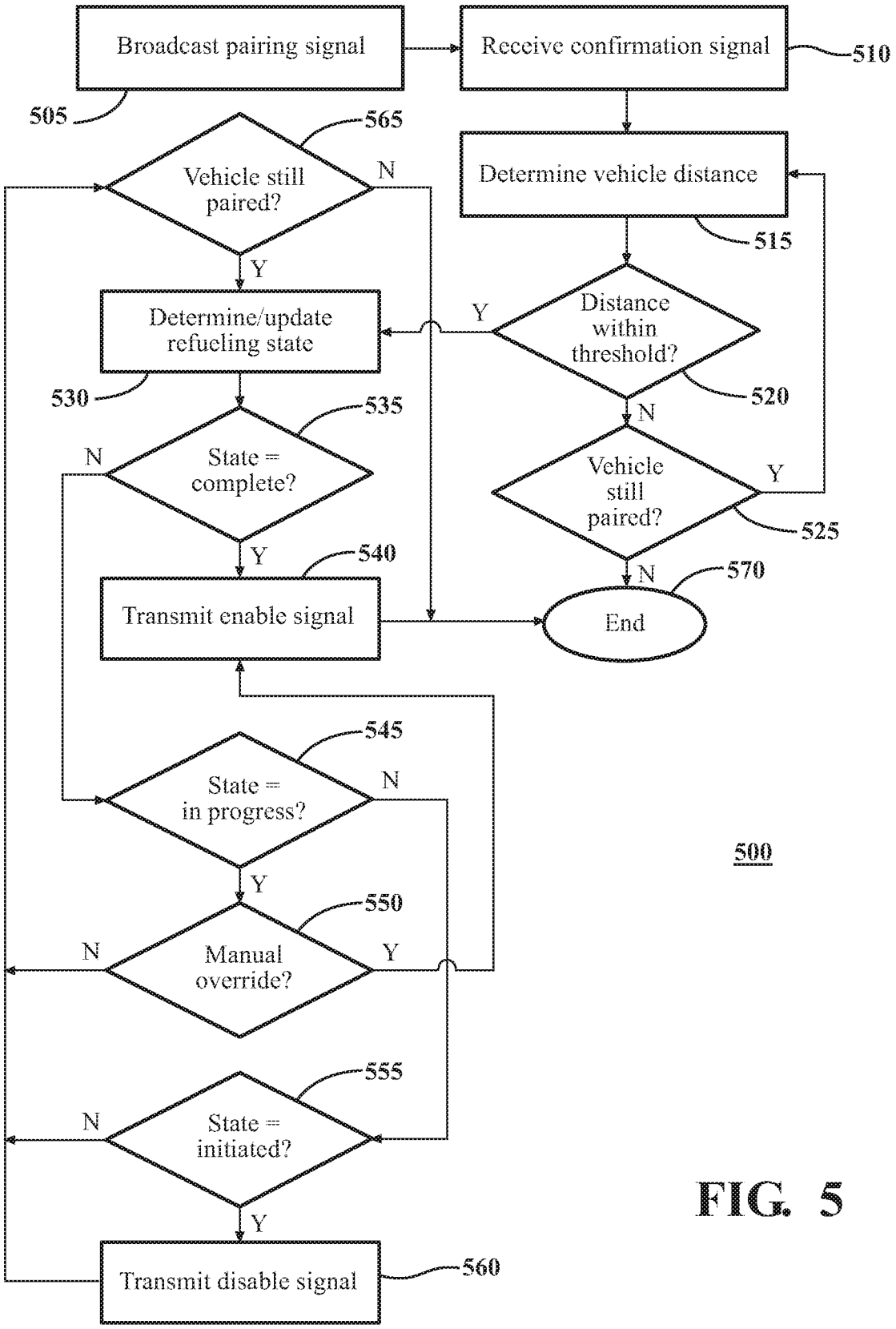
FIG. 5 illustrates a flow chart of a method of controlling a fuel dispenser according to the disclosed subject matter.

FIG. 5 illustrates a flowchart of an example method 500 that is associated with operations of the disclosed fuel dispenser control system 100. The method 500 will be discussed from the perspective of the disclosed fuel dispenser control system 100 of FIGS. 1-4. While the method 500 is discussed in combination with the system 100, it should be appreciated that the method 500 is not limited to being implemented within system 100 and fuel dispenser 200, which are merely one example of a system and facility that may implement the method 500. Furthermore, one of ordinary skill in the art will recognize that the method 500 is merely one example method of implementing the disclosed embodiments. Different variations may be constructed according to implementation in a given setting or situation.

At operation 505 the communication module 130 broadcasts a scanning or paring signal via the wireless communication device 170. When a vehicle 300 enters the range of the broadcast and responds, the pairing process is executed and the communication module 130 receives a confirmation signal indicating the pairing process is complete at operation 510.

At operation 515 the control module 140 determines a distance D between the vehicle 300 and the fuel dispenser 200. At operation 520 the control module 140 determines whether the vehicle 300 has approached to within a threshold distance, e.g., a distance that indicates an intent to refuel the vehicle 300 at the fuel dispenser 200. For example, it may be possible that the vehicle 300 is merely passing by to a different dispenser or to a store associated with the station. If the distance D is not below the threshold, at operation 525 the control module 140 checks whether the vehicle 300 is still paired to the fuel dispenser 200. If the vehicle 300 has left the range of the communication module 130, the pairing is nullified and the process ends at 570. If the vehicle 300 is still paired to the fuel dispenser, the control module 140 returns to operation 515 to continue to monitor the distance D.

When the paired vehicle 300 moves within the threshold range, at operation 530 the control module 140 determines a refueling state of the vehicle 300. In one or more embodiments, the refueling states can be defined as one of: an initial state pending a refueling session (i.e. "pending"), initiation of refueling (i.e., "initiating"), refueling in progress (i.e., "in progress"), and refueling complete (i.e., "complete"). Generally, in operations 530-565 the control module 140 takes appropriate action according to the disclosed embodiments based on the determination of the refueling state, e.g., transmit a disable signal when the refueling process begins and transmit an enable signal when the refueling process is complete, while simultaneously monitoring for an override signal.

Operation 530-565 are one example algorithmic loop that the control module 140 can execute to determine an action based on the refueling state. A person of ordinary skill in the art will recognize that changes can be made to the algorithm, e.g., different order of operations, inclusion of other operations, etc., while still achieving the same outcome. Embodiments of the disclosed subject matter can utilize such altered algorithms in different implementations.

At operation 530 the vehicle 300 has already paired with the fuel dispenser 200 and been detected within the threshold range that indicates an intent to refuel. The control module 140 therefore determines and updates a refueling state 165 of the vehicle 300. In one or more embodiments, the control module 140 can store an initial state of "pending" as a refueling state 165 in the data store 150. This initial state corresponds to the period during which the vehicle has entered the threshold range, e.g., pulled up next to the fuel dispenser 200, but actual refueling of the vehicle has not yet begun, e.g. the driver may be exiting the vehicle 300, checking text messages, etc. While the refueling state is pending, the control module 140 will take no immediate action but continue to monitor the refueling state of the vehicle 300 and the pairing state of the vehicle 300, as will be discussed below, in what may be referred to as a 'refueling session loop' implemented in operations 535, 545, 550, 555 and 565.

The order of operations 535, 545, 550, 555 and 565 is presented in the form of flowchart 500 to provide a useful, visual, logical progression, however, this is merely one embodiment of the disclosed subject matter. Generally, the control module 140 periodically determines the refueling state 165 of the vehicle 300 and pairing status and takes appropriate action. Different orderings in different embodiments of the disclosed subject matter can achieve the outcome of the refueling session loop as described herein.

At operation 555 the control module 140 determines whether the refueling state 165 of the vehicle 300 is initiated. In one or more embodiments, the control module 140 can determine that the refueling state of the vehicle 300 is initiated based at least in part on detecting removal of the fuel nozzle 210 from the fuel dispenser 200. For example, a sensor (not shown) can output a signal to the control module 140 when the fuel nozzle 210 is removed or replaced from the fuel dispenser 200. Based on the signal indicating removal of the fuel nozzle 210 and the current refueling state being pending, the control module 140 can determine the refueling session is initiated.

In one or more embodiments, the control module 140 can determine that the refueling state of the vehicle 300 is initiated based at least in part on receiving a signal from the vehicle 300. For example, the vehicle 300 can transmit a signal when a fuel port door of the vehicle 300 is opened, or when a sensor of the vehicle 300 detects insertion of the fuel nozzle 210 into a fuel port inlet of the vehicle 300. In one or more embodiments, the control module 140 can determine that the refueling state of the vehicle 300 is initiated based at least in part on a combination of signals, e.g., a signal from the fuel dispenser sensor indicating removal of the fuel nozzle 210 and a signal from the vehicle 300 indicating an opening of the fuel port door and/or insertion of the fuel nozzle 210 into a fuel port inlet of the vehicle 300.

In any case, after determining that a refueling session is initiated the control module 140 can proceed to transmit a disabling signal at operation 560 to disable a moving capability of the vehicle 300. In one or more embodiments, the control module 140 can further transmit a notification indicating that the vehicle 300 is disabled from moving and providing instructions for a manual override. In one or more embodiments, the instructions can include a manual override code, such as a randomly generated number. The notification and code can be transmitted, for example, to a display of the fuel dispenser 200 or directly to the vehicle 300 or to a mobile computing device, such as a cell phone or a smart watch.

The process then returns to operation 565 to confirm that the vehicle 300 is still paired to the fuel dispenser 200. If the vehicle 300 is no longer paired, then it is presumed that the vehicle 300 has departed and the process ends at operation 570. If the vehicle 300 remains paired, then the control module 140 updates the refueling status to 'in progress' at operation 530 and the refueling session loop continues.

At operation 545 the control module 140 determines whether the refueling state 165 of the vehicle 300 is in progress. The refueling state 165 may be in progress when the control module 140 has already determined that the refueling session has been initiated but has not yet determined that the refueling session has been completed. When the control module 140 determines that the refueling state 165 is not in progress, the refueling session loop continues, that is, the control module 140 continues to monitor for changes in the pairing status (operation 565) and the refueling state (operation 530). When the control module 140 determines that the refueling session is currently in progress, at operation 550 the control module 140 determines whether a manual override signal has been received.

In one or more embodiments a manual override signal can be generated, for example, by entering an override code at the fuel dispenser 200, entering the code at a computer system within the station, or transmitting the code through some other channel, for example, by texting the code to a provided number of a control system connected to the fuel dispenser. In any case, if a manual override signal is received, at operation 540 the control module 140 immediately transmits an enable signal to enable the moving capability of the vehicle 300 and the process ends at operation 570. If no manual override signal has been received, the control module 140 continues the refueling session loop, that is, continues to monitor for changes/updates to the pairing status of the vehicle 300 (operation 565) and the refueling state of the vehicle 300 (operation 530).

At operation 535 the control module 140 determines whether the refueling state 165 of the vehicle 300 is complete. In one or more embodiments, the control module 140 can determine that the refueling state of the vehicle 300 is complete based at least in part on detecting replacement of the fuel nozzle 210 at the fuel dispenser 200. For example, a sensor (not shown) can output a signal to the control module 140 when the fuel nozzle 210 is removed or replaced from the fuel dispenser 200. Based on the signal indicating replacement of the fuel nozzle 210, the control module 140 can determine the refueling session is finished.

In one or more embodiments, the control module 140 can determine that the refueling state of the vehicle 300 is complete based at least in part on receiving a signal from the vehicle 300. For example, the vehicle 300 can transmit a signal when a fuel port door of the vehicle 300 is closed, or when a sensor of the vehicle 300 detects removal of the fuel nozzle 210 from a fuel port inlet of the vehicle 300. In one or more embodiments, the control module 140 can determine that the refueling state of the vehicle 300 is compete based at least in part on a combination of signals, e.g., a signal from the fuel dispenser sensor indicating replacement of the fuel nozzle 210 and a signal from the vehicle 300 indicating a closing of the fuel port door and/or removal of the fuel nozzle 210 from a fuel port inlet of the vehicle 300.

In any case, after determining that a refueling session is complete the control module 140 can proceed to proceed to transmit an enabling signal at operation 540 to restore the moving capability of the vehicle 300. The process then ends at 570.

Accordingly, the disclosed fuel dispenser control system can advantageously communicate with an incoming vehicle to achieve a secure channel of communication, determine an intent to refuel based at least on the vehicle approaching within a threshold distance, determine when a refueling session has been initiated, disable the vehicle from driving away while the refueling session is ongoing (i.e., while the fuel nozzle is inserted into the vehicle fuel port inlet), and enable the vehicle to depart when the refueling session is complete (i.e., when the fuel nozzle is no longer inserted in the vehicle fuel port inlet). The disclosed embodiments provide multiple measures to reduce the chance of a disable signal being sent prematurely or to a wrong vehicle, and furthermore provides ways for a driver to be informed of the situation and to remain in control in the event of an emergency by providing a manual override option. Thus, the disclosed embodiments significantly reduce a likelihood of a dangerous accident occurring at a fuel dispenser caused by a vehicle driving away during a refueling session while the fuel nozzle is still inserted in the vehicle fuel port.

In addition to the above described configurations, it should be appreciated that the fuel dispenser control system 100 from FIG. 1 can be configured in various arrangements with separate integrated circuits and/or chips. In such embodiments, the control module 140 and communication module 130 can each be embodied on individual integrated circuits. The circuits can be connected via connection paths to provide for communicating signals between the separate circuits. Of course, while separate integrated circuits are discussed, in various embodiments, the circuits may be integrated into a common integrated circuit board. Additionally, the integrated circuits may be combined into fewer integrated circuits or divided into more integrated circuits. In another embodiment, the modules 130 and 140 may be combined into a separate application-specific integrated circuit. In further embodiments, portions of the functionality associated with the modules 130 and 140 may be embodied as firmware executable by a processor and stored in a non-transitory memory. In still further embodiments, the modules 130 and 140 are integrated as hardware components of the processor 110.

In another embodiment, the described methods and/or their equivalents may be implemented with computer-executable instructions. Thus, in one embodiment, a non-transitory computer-readable medium is configured with stored computer executable instructions that when executed by a machine (e.g., processor, computer, and so on) cause the machine (and/or associated components) to perform the method.

While for purposes of simplicity of explanation, the illustrated methodologies in the figures are shown and described as a series of blocks, it is to be appreciated that the methodologies (e.g., method 500 of FIG. 5) are not limited by the order of the blocks, as some blocks can occur in different orders and/or concurrently with other blocks from that shown and described. Moreover, less than all the illustrated blocks may be used to implement an example methodology. Blocks may be combined or separated into multiple components. Furthermore, additional and/or alternative methodologies can employ additional blocks that are not illustrated.

As previously described, the fuel dispenser control system 100 can include one or more processors 110. In one or more arrangements, the processor(s) 110 can be a main processor of the fuel dispenser control system 100. For instance, the processor(s) 110 can be an electronic control unit (ECU). The fuel dispenser control system 100 can include one or more data stores for storing one or more types of data. The data stores can include volatile and/or non-volatile memory. Examples of suitable data stores include RAM (Random Access Memory), flash memory, ROM (Read Only Memory), PROM (Programmable Read-Only Memory), EPROM (Erasable Programmable Read-Only Memory), EEPROM (Electrically Erasable Programmable Read-Only Memory), registers, magnetic disks, optical disks, hard drives, distributed memories, cloud-based memories, other storage medium that are suitable for storing the disclosed data, or any combination thereof. The data stores can be a component of the processor(s) 110, or the data store can be operatively connected to the processor(s) 110 for use thereby. The term "operatively connected," as used throughout this description, can include direct or indirect connections, including connections without direct physical contact.

Detailed embodiments are disclosed herein. However, it is to be understood that the disclosed embodiments are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various embodiments are shown in FIGS. 1-5, but the embodiments are not limited to the illustrated structure or application.

The flowcharts and block diagrams in the figures illustrate the architecture, functionality, and operation of possible implementations of systems, methods, and computer program products according to various embodiments. In this regard, each block in the flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The systems, components and/or processes described above can be realized in hardware or a combination of hardware and software and can be realized in a centralized fashion in one processing system or in a distributed fashion where different elements are spread across several interconnected processing systems. Any kind of processing system or another apparatus adapted for carrying out the methods described herein is suited. A combination of hardware and software can be a processing system with computer-usable program code that, when being loaded and executed, controls the processing system such that it carries out the methods described herein. The systems, components and/or processes also can be embedded in a computer-readable storage, such as a computer program product or other data programs storage device, readable by a machine, tangibly embodying a program of instructions executable by the machine to perform methods and processes described herein. These elements also can be embedded in an application product which comprises all the features enabling the implementation of the methods described herein and, which when loaded in a processing system, is able to carry out these methods.

Furthermore, arrangements described herein may take the form of a computer program product embodied in one or more computer-readable media having computer-readable program code embodied, e.g., stored, thereon. Any combination of one or more computer-readable media may be utilized. The computer-readable medium may be a computer-readable signal medium or a computer-readable storage medium. The phrase "computer-readable storage medium" means a non-transitory storage medium. A computer-readable medium may take forms, including, but not limited to, non-volatile media, and volatile media. Non-volatile media may include, for example, optical disks, magnetic disks, and so on. Volatile media may include, for example, semiconductor memories, dynamic memory, and so on. Examples of such a computer-readable medium may include, but are not limited to, a floppy disk, a flexible disk, a hard disk, a magnetic tape, other magnetic medium, an ASIC, a CD, other optical medium, a RAM, a ROM, a memory chip or card, a memory stick, and other media from which a computer, a processor or other electronic device can read. In the context of this document, a computer-readable storage medium may be any tangible medium that can contain, or store a program for use by or in connection with an instruction execution system, apparatus, or device.

The following includes definitions of selected terms employed herein. The definitions include various examples and/or forms of components that fall within the scope of a term and that may be used for various implementations. The examples are not intended to be limiting. Both singular and plural forms of terms may be within the definitions.

References to "one embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer to the same embodiment, though it may.

"Module," as used herein, includes a computer or electrical hardware component(s), firmware, a non-transitory computer-readable medium that stores instructions, and/or combinations of these components configured to perform a function(s) or an action(s), and/or to cause a function or action from another logic, method, and/or system. Module may include a microprocessor controlled by an algorithm, a discrete logic (e.g., ASIC), an analog circuit, a digital circuit, a programmed logic device, a memory device including instructions that when executed perform an algorithm, and so on. A module, in one or more embodiments, includes one or more CMOS gates, combinations of gates, or other circuit components. Where multiple modules are described, one or more embodiments include incorporating the multiple modules into one physical module component. Similarly, where a single module is described, one or more embodiments distribute the single module between multiple physical components.

Additionally, module as used herein includes routines, programs, objects, components, data structures, and so on that perform particular tasks or implement particular data types. In further aspects, a memory generally stores the noted modules. The memory associated with a module may be a buffer or cache embedded within a processor, a RAM, a ROM, a flash memory, or another suitable electronic storage medium. In still further aspects, a module as envisioned by the present disclosure is implemented as an application-specific integrated circuit (ASIC), a hardware component of a system on a chip (SoC), as a programmable logic array (PLA), or as another suitable hardware component that is embedded with a defined configuration set (e.g., instructions) for performing the disclosed functions.

In one or more arrangements, one or more of the modules described herein can include artificial or computational intelligence elements, e.g., neural network, fuzzy logic or other machine learning algorithms. Further, in one or more arrangements, one or more of the modules can be distributed among a plurality of the modules described herein. In one or more arrangements, two or more of the modules described herein can be combined into a single module.

Program code embodied on a computer-readable medium may be transmitted using any appropriate medium, including but not limited to wireless, wireline, optical fiber, cable, RF, etc., or any suitable combination of the foregoing. Computer program code for carrying out operations for aspects of the present arrangements may be written in any combination of one or more programming languages, including an object-oriented programming language such as Java™ Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The phrase "at least one of . . . and . . . " as used herein refers to and encompasses any and all possible combinations of one or more of the associated listed items. As an example, the phrase "at least one of A, B, and C" includes A only, B only, C only, or any combination thereof (e.g., AB, AC, BC or ABC).

Aspects herein can be embodied in other forms without departing from the spirit or essential attributes thereof. Accordingly, reference should be made to the following claims, rather than to the foregoing specification, as indicating the scope hereof.

What is claimed is:

1. A fuel dispenser control system for a fuel dispenser, comprising:

a wireless communication device;

one or more proximity sensors;

one or more processors; and a memory communicably connected to the one or more processors and storing:

a communication module including one or more instructions that, when executed by the one or more processors, cause the one or more processors to broadcast a pairing signal to a vehicle and receive a confirmation signal from the vehicle confirming completion of a pairing process between the fuel dispenser and the vehicle; and a control module including one or more instructions that, when executed by the one or more processors, cause the one or more processors to transmit, subsequent to the confirmation signal, a disable signal to the vehicle in response to data from the one or more proximity sensors indicating that the vehicle is within a threshold range and a determination that the vehicle is refueling, and to transmit an enable signal to the vehicle in response to a determination that the vehicle is no longer refueling, wherein the control module further includes instructions to determine that the vehicle is at least one of:

refueling based at least in part on detecting a fuel nozzle being removed from the fuel dispenser, or no longer refueling based at least in part on detecting the fuel nozzle being replaced in the fuel dispenser, wherein the disable signal disables a moving capability of the vehicle, and the enable signal restores the moving capability of the vehicle, and wherein the fuel dispenser control system is configured to be disposed on the fuel dispenser.

2. The fuel dispenser control system of claim 1, wherein the instructions to determine that the vehicle is refueling further include instructions to determine that the vehicle is refueling based at least in part on a refueling signal received from the vehicle, the refueling signal being triggered by a fuel port of the vehicle being opened.

3. The fuel dispenser control system of claim 1, wherein the instructions to determine that the vehicle is no longer refueling further include instructions to determine that the vehicle is no longer refueling based at least in part on a completion signal being received from the vehicle, the completion signal being triggered by a fuel port of the vehicle being closed.

4. The fuel dispenser control system of claim 1, wherein the communication module further includes instructions to transmit a first notification to the vehicle indicating that the moving capability of the vehicle is disabled and a second notification to the vehicle indicating that the moving capability of the vehicle is enabled.

5. The fuel dispenser control system of claim 4, wherein the first notification includes information about a way to execute a manual override procedure that enables the moving capability of the vehicle.

6. A method of controlling a fuel dispenser, comprising:

broadcasting a pairing signal to a vehicle;

receiving, from the vehicle, a confirmation signal confirming completion of a pairing process between the fuel dispenser and the vehicle;

transmitting, subsequent to the confirmation signal, a disable signal to the vehicle in response to data from one or more proximity sensors indicating that the vehicle is within a threshold range and a determination that the vehicle is refueling; and transmitting an enable signal to the vehicle in response to a determination that the vehicle is no longer refueling, wherein at least one of:

the determination that the vehicle is refueling is based at least in part on detecting a fuel nozzle being removed from the fuel dispenser, or the determination that the vehicle is no longer refueling is based at least in part on detecting the fuel nozzle being replaced in the fuel dispenser, wherein the disable signal disables a moving capability of the vehicle, and the enable signal restores the moving capability of the vehicle, and wherein the broadcasting, the receiving, the transmitting the disable signal, and the transmitting the enable signal are controlled by a processor configured to be disposed on the fuel dispenser.

7. The method of claim 6, wherein the determination that the vehicle is refueling is further based at least in part on a refueling signal received from the vehicle, the refueling signal being triggered by a fuel port of the vehicle being opened.

8. The method of claim 6, wherein the determination that the vehicle is no longer refueling is further based at least in part on a completion signal being received from the vehicle, the completion signal being triggered by a fuel port of the vehicle being closed.

9. The method of claim 6, further comprising:

transmitting a first notification to the vehicle indicating that the moving capability of the vehicle is disabled; and transmitting a second notification to the vehicle indicating that the moving capability of the vehicle is enabled.

10. The method of claim 9, wherein the first notification includes information about a way to execute a manual override procedure that enables the moving capability of the vehicle.

11. A non-transitory computer-readable medium storing instructions for controlling a fuel dispenser and that when executed by one or more processors cause the one or more processors to:

broadcast a pairing signal to a vehicle;

receive, from the vehicle, a confirmation signal confirming completion of a pairing process between the fuel dispenser and the vehicle;

transmit, subsequent to the confirmation signal, a disable signal to the vehicle in response to data from one or more proximity sensors indicating that the vehicle is within a threshold range and a determination that the vehicle is refueling; and transmit an enable signal to the vehicle in response to a determination that the vehicle is no longer refueling, wherein at least one of:

the determination that the vehicle is refueling is based at least in part on a detection that a fuel nozzle is removed from the fuel dispenser, or the determination that the vehicle is no longer refueling is based at least in part on a detection that the fuel nozzle is replaced in the fuel dispenser, wherein the disable signal disables a moving capability of the vehicle, and the enable signal restores the moving capability of the vehicle, and wherein the non-transitory computer-readable medium is configured to be disposed on the fuel dispenser.

12. The non-transitory computer-readable medium of claim 11, wherein the determination that the vehicle is refueling is further based at least in part on a refueling signal received from the vehicle, the refueling signal being triggered by a fuel port of the vehicle being opened.

13. The non-transitory computer-readable medium of claim 11, wherein the determination that the vehicle is no longer refueling is further based at least in part on a completion signal being received from the vehicle, the completion signal being triggered by a fuel port of the vehicle being closed.

14. The non-transitory computer-readable medium of claim 11, further comprising instructions to:

transmit a first notification to the vehicle indicating that the moving capability of the vehicle is disabled; and transmit a second notification to the vehicle indicating that the moving capability of the vehicle is enabled.

15. The fuel dispenser control system of claim 1, wherein the disable signal is configured to prevent an engine of the vehicle from at least one of starting or shifting into gear.

16. The fuel dispenser control system of claim 1, wherein the confirmation signal includes identification information usable to determine a code to transmit within the disable signal.

17. The method of claim 6, wherein the disable signal is configured to prevent an engine of the vehicle from at least one of starting or shifting into gear.

18. The method of claim 6, wherein the confirmation signal includes identification information usable to determine a code to transmit within the disable signal.

19. The non-transitory computer-readable medium of claim 11, wherein the disable signal is configured to prevent an engine of the vehicle from at least one of starting or shifting into gear.

20. The non-transitory computer-readable medium of claim 11, wherein the confirmation signal includes identification information usable to determine a code to transmit within the disable signal.

* * * * *